US005190022A

United States Patent [19]

Larson

[11] Patent Number: 5,190,022

[45] Date of Patent: Mar. 2, 1993

[54] ARROW QUIVER WITH ADJUSTABLE ARROW SHAFT CLAMP

[75] Inventor: Marlow W. Larson, Ogden, Utah

[73] Assignee: Browning, Morgan, Utah

[21] Appl. No.: 786,301

[22] Filed: Nov. 1, 1991

[51] Int. Cl.[5] ..... F41B 5/06

[52] U.S. Cl. ..... 124/25.7; 124/25.5; 124/41.1; 124/88

[58] Field of Search ..... 124/25.7, 25.5, 41.1, 124/45, 88, 86, 23.1, 24.1, 25.6, 44.5

[56] References Cited

U.S. PATENT DOCUMENTS

| | | | |
|---|---|---|---|
| 2,802,611 | 8/1957 | Jenkins et al. | 124/41.1 X |
| 3,116,730 | 1/1964 | Tingley | 124/24.1 |
| 3,366,101 | 1/1968 | Saunders | 124/25.7 X |
| 3,561,651 | 2/1971 | Ramsey | 124/25.7 X |
| 3,595,214 | 7/1971 | O'Malley | 124/25.7 |
| 3,716,174 | 2/1973 | Ehlert | 124/25.7 X |
| 3,777,734 | 12/1973 | Rose | 124/25.5 |
| 4,020,984 | 5/1977 | Morris | 124/25.7 X |
| 4,156,496 | 5/1979 | Stinson | 124/25.7 |
| 4,632,087 | 12/1986 | Cline | 124/44.5 |
| 4,685,438 | 8/1987 | Larson | 124/86 X |
| 4,788,961 | 12/1988 | Toth | 124/88 X |

*Primary Examiner*—Andrew V. Kundrat
*Assistant Examiner*—Harry C. Kim
*Attorney, Agent, or Firm*—Trask, Britt & Rossa

[57] ABSTRACT

An archery quiver includes a arrow clamp assembly with manually or spring biased adjustable gripping elements, whereby arrows of significantly different diameters can be accepted by the assembly.

11 Claims, 2 Drawing Sheets

ARROW QUIVER WITH ADJUSTABLE ARROW SHAFT CLAMP

BACKGROUND

1. Field

This invention pertains to archery bows. It is particularly directed to quivers, and provides an improved quiver capable of holding arrows of different shaft diameters.

2. State of The Art

In the sport of archery, it is common practice to mount a quiver device on the handle riser of a bow. Modern quivers are structured and arranged to hold arrows approximately vertically with their points up and contained within a hood. The individual arrows are maintained in this position by a shaft clamp arrangement. A serious limitation of such quivers is that the arrow shaft clamps in current use are capable of holding shafts having diameters within only a selected narrow range. Arrows are available in a wide range of shaft sizes, however. Moreover, it is not unusual for an individual archer to utilize arrows of significantly divergent shaft diameter, depending upon a number of factors. For example, an archer will often select different arrows for hunting than for target competition. Economic considerations may influence the mix of arrows possessed by an archer. Developing technology results in the availability of new arrow designs which archers may wish to test in the field on a limited basis prior to discarding their current stocks of arrows of greater or smaller diameter.

Arrows currently in use include those having aluminum shafts ranging in different models from about 14 to about 25 64ths of an inch in diameter. Wooden arrow shafts are also available in a range of diameters, typically about 5/16 inch. Graphite shafts are conventionally measured in thousandths of an inch, a typical such shaft size being 0.210 inch.

Under present circumstances, one wishing to enter the field with arrows of a significantly different shaft size than those last quivered on his bow, must either change quivers or replace the arrow clamps on the quiver in use. That is, a typical arrow clamp intended for use with a specific shaft diameter will not hold a shaft of significantly smaller diameter and will accept a shaft of significantly greater diameter only by the application of distorting force.

There remains a need for an archery quiver capable of accepting arrow shafts of significantly different diameters.

SUMMARY OF THE INVENTION

This invention provides an improvement to archery quivers which enables them to accept arrows with shafts of virtually any available diameter. While the invention may be embodied as a complete quiver, it may also be embodied as a retrofit arrow shaft clamp which can replace the corresponding shaft clamps of quivers of other designs.

A quiver of this invention includes a support member and hood member of conventional design. These members provide for attachment of the quiver to the handle riser of a bow and for the enclosure of sharp arrow points. The departure from conventional design offered by this invention resides in the arrow shaft clamp member. This member provides for adjustment of gripper elements within the clamp to accommodate shafts of different diameters.

The gripper elements of this invention may be individually mounted or they may comprise components of an array of grippers. In such an array, the grippers may operate individually, or they may operate in unison. Unison or ganged operation is often preferred in normal circumstances in which all of the arrows carried by an archer at any given time are approximately identical in size, weight and other characteristics. The adjustability offered by this invention is then important primarily to accommodate the substitution of one quiver set of arrows for another of different shaft diameter.

BRIEF DESCRIPTION OF THE DRAWINGS

In the drawings, which illustrate that which is presently regarded as the best mode for carrying out the invention.

DESCRIPTION OF THE ILLUSTRATED EMBODIMENTS

Figure 1:
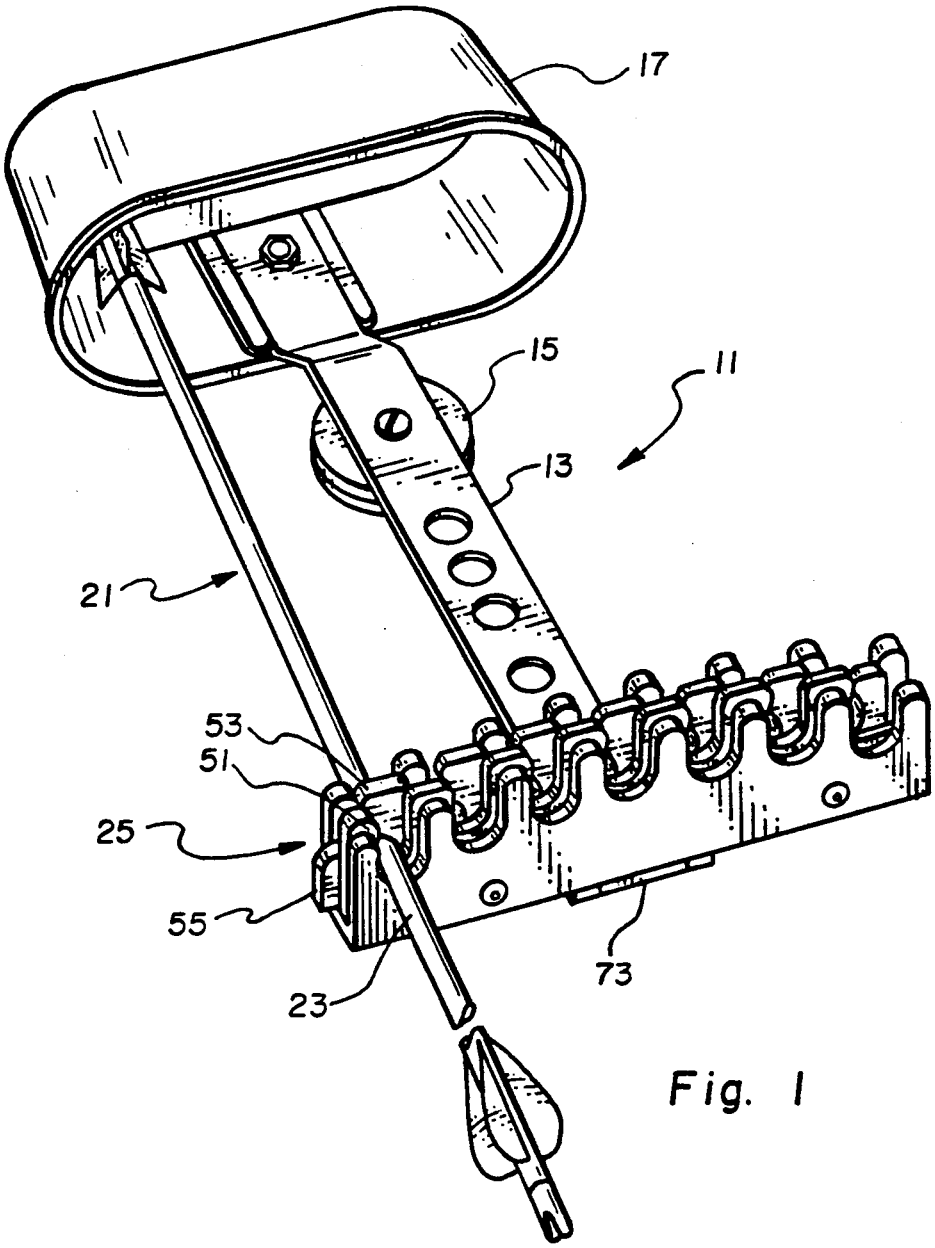
FIG. 1 is a pictorial illustration of an archery arrow quiver of this invention.

A quiver 11 of this invention, as illustrated by FIG. 1, includes a mounting support 13 and an associated connector 15, by which the quiver 11 is mounted to the handle riser of a bow (not shown). A hood 17 is attached to one end of the support 13. The hood functions to enclose the sharp arrow points carried by the forward ends of arrows carried by the quiver 11. A single such arrow 21 is shown stored in the quiver 11 to illustrate the manner in which an arrow shaft 23 is accepted by a clamp member assembly 25.

The assembly 25 is of the type in which the shafts 23 of all of the arrows carried by a quiver 11 are expected to be of approximately the same diameter, or at least to vary in diameter within a narrow range. The shafts 23 may, however, be selected from the smallest available graphite shaft (e.g. about 1/5 inch) to the largest available aluminum shaft (e.g. 25/64 inch).

Figure 3:
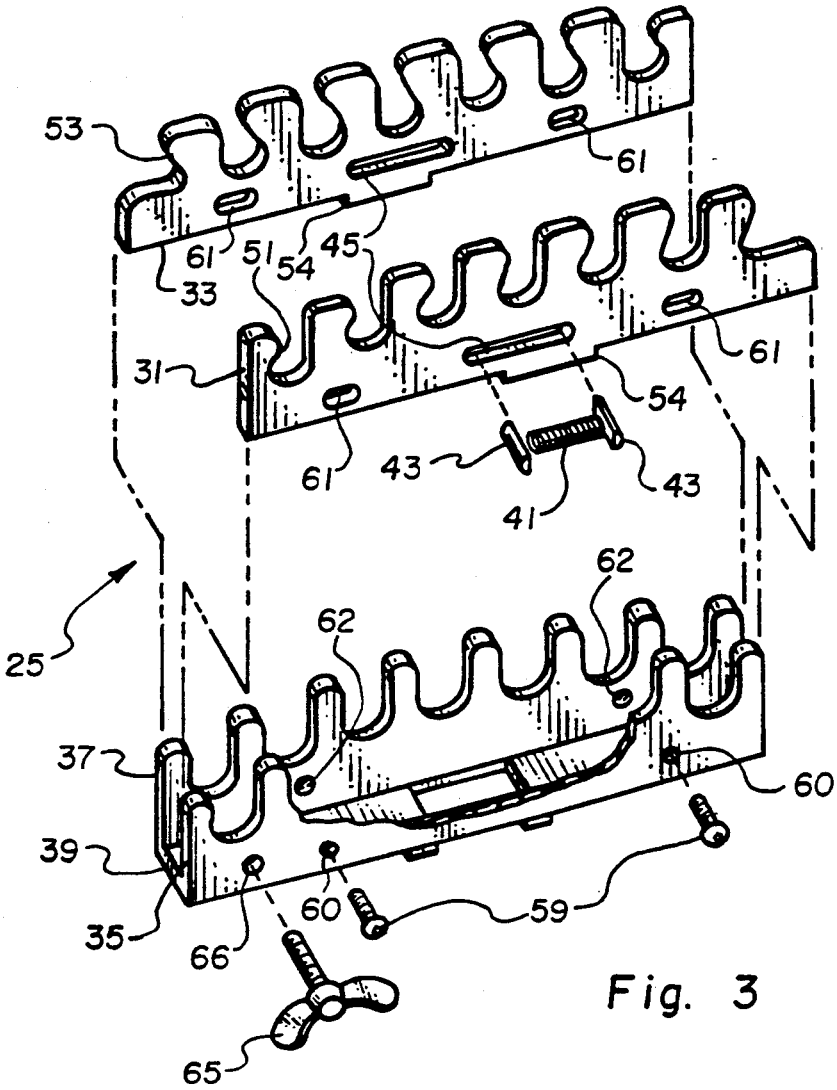
FIG. 3 is an exploded pictorial view of an arrow clamp of alternative construction to that illustrated by FIG. 1.

As best shown by FIG. 3, a pair of gripper elements 31, 33, is installed between rigid structural elements 35, 37, which are upstanding from a base plate 39. The gripper elements 31, 33, are preferably fashioned from resilient elastomeric materials or other materials which have similar properties. They are biased by means of a spring 41 compressed between opposed spring retainers 43 which upon assembly are placed transversely in slots 45 provided in the respective gripper elements 31, 33. The biasing provided by the spring effects a clamping action by opposed gripping surfaces, e.g. 51, 53, on an arrow shaft, e.g. 21. The tabs 54 may be pressed to move the gripper elements against the spring bias, thereby creating a sufficient opening between adjacent opposed gripping surfaces 51, 53, to permit entry of the first arrow shaft 23 accepted by the assembly 25.

Referring to FIG. 23, one of the gripper elements, e.g. 31, may be fastened to the structural element 35. In that event, pressure applied to the tab extension 55 moves the biased gripper element 33 to adjust the spacing between the surfaces 51, 53.

Additional arrows of the same or nearly the same shaft diameters can thereafter be inserted without difficulty, being held in place by the natural resiliency of the gripper elements 31, 33. The gripper elements 31, 33 are held in association with the elements 35, 37, by fasteners 59, extending through bores 60 and slots 61, being eventually turned into threaded bores 62.

Figure 2:
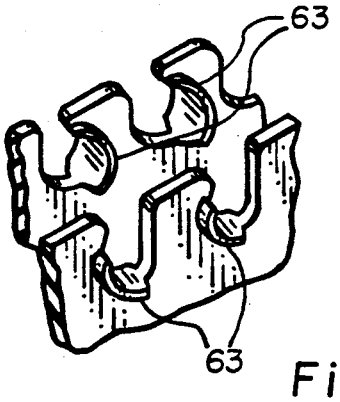
FIG. 2 is a fragmentary pictorial view of an alternative arrow clamp structure of this invention.
Figure 4:
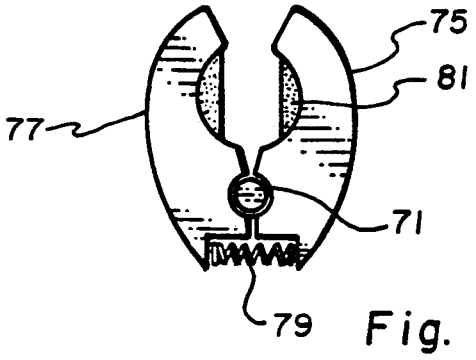
FIG. 4 is a plan view of an alternative individual arrow clamp of this invention.

Embodiments are within contemplation in which the relative positioning of the gripper elements 31, 33, is adjustable manually; that is without the assistance of spring biasing. No matter how the spacing between the surfaces 51, 53 is established; that is against spring bias of one or both gripper elements 51, 53 or without the assistance of spring biasing, once adjusted, this spacing may be secured by mechanically fixing the relative positions of these elements 31, 33. A wingnut 65 turned into threaded bore 66, as shown by FIG. 3, will suffice for this purpose. Other embodiments utilize extension bosses 63 (FIG. 2) on the gripper elements 31, 33, to provide more positive clamping action. The bosses 63 increase the contact surface area available to clamp the arrow shaft. FIG. 4 illustrates one form of an individual arrow clamp. It is within contemplation that a plurality of such individual clamps be substituted for the assembly 25. As shown, the central pin 71 functions as an anchor to a support, similar to the base support 39 which is then connected to the lower end 73 of the quiver support 13. Opposed jaws 75, 77 are biased closed by a spring 79. The jaws are thus capable of clamping arrow shafts of different diameters between resilient boss elements 81.

Reference herein to details of the illustrated and preferred embodiments is not intended to limit the scope of the appended claims, which themselves recite those features regarded as important to the invention.

What is claimed is:

1. An archery quiver comprising:

a support member structured and arranged for attachment to the handle riser of an archery bow and having a first end and a second end;

a hood member carried by said first end of said support member, being structured and arranged to receive the pointed ends of a plurality of arrows, each said arrow having a shaft, a nock end and a point end; and an arrow shaft clamp member carried by said second end of said support member, said clamp member including at least one set of first and second gripper elements, an arrow shaft retaining notch in each of said gripper elements, a resilient arrow engaging surface in each retaining notch, and resilient means being structurally different from said gripper elements and biasing each of said gripper elements and said retaining notches to an arrow shaft gripping position.

2. An archery quiver as in claim 1, wherein said first and second gripper elements are mounted on a common pivot shaft.

3. An archery quiver as in claim 1, wherein said first and second gripper elements are mounted so that at least one of said elements slides with respect to the other in a face-to-face relationship.

4. An archery quiver as in claim 3, wherein one of said pair gripper elements has a plurality of said notches formed therein; and said other of said pair of gripper elements has a corresponding plurality of said notches formed therein.

5. An archery quiver as in claim 3, further including a base plate fixed to and extending transversely of said support member, a pair of spaced apart structural elements fixed to and extending from said base plate; and wherein said gripper elements are positioned between said spaced apart structural elements.

6. An archery quiver as in claim 5, further including means to clamp one of said gripper elements to one of said structure elements.

7. An archery quiver as in claim 6, further including means on the other gripper element projecting beyond said structural elements to be engaged to slide said other said gripper element relative to the said gripper element clamped to said one of said structural elements.

8. An archery quiver comprising:

a support member structured and arranged for attachment to the handle riser of an archery bow and having a first end and a second end;

a hood member carried by said first end of said support member, being structured and arranged to receive the pointed ends of a plurality of arrows, each said arrow having a shaft, a nock end and a point end; and an arrow shaft clamp member carried by said second end of said support member, said clamp member including at least one first gripper element having at least one arrow shaft retaining notch formed therein and a second gripper element having at least one arrow shaft retaining notch formed therein, a resilient arrow engaging surface in each retaining notch, said gripper elements being held in face-to-face relationship and at least one of said gripper elements being slidable with respect to the other gripper element.

9. An archery quiver as in claim 8, further including means to releasably clamp said gripper elements together to prevent sliding movement between said gripper elements.

10. An archery quiver as in claim 9, further including a base plate fixed to and extending transversely of said support member, a pair of spaced apart structural elements fixed to and extending from said base plate; and wherein said gripper elements are positioned between said spaced apart structural elements.

11. An archery quiver as in claim 10, further including means to clamp one of said gripper elements to one of said structural elements.

* * * * *